US007128215B2

(12) United States Patent
Danechi

(10) Patent No.: US 7,128,215 B2
(45) Date of Patent: Oct. 31, 2006

(54) CONTAINER FOR COTTON SWABS

(76) Inventor: Sasan Danechi, Elegardsvej 15, 2820, Gentofte (DK)

( * ) Notice: Subject to any disclaimer, the term of this patent is extended or adjusted under 35 U.S.C. 154(b) by 0 days.

(21) Appl. No.: 10/807,622

(22) Filed: Mar. 23, 2004

(65) Prior Publication Data

US 2005/0211584 A1 Sep. 29, 2005

(51) Int. Cl.
*B65D 69/00* (2006.01)

(52) U.S. Cl. ..... 206/755; 206/362; 206/804; 132/315; 132/318

(58) Field of Classification Search ..... 206/362, 206/751, 754, 755, 804, 581; 220/23.87, 220/23.89, 409; 132/315, 318; 221/247, 221/248, 249
See application file for complete search history.

(56) References Cited

U.S. PATENT DOCUMENTS

| | | | | | |
|---|---|---|---|---|---|
| 102,471 | A | * | 5/1870 | Avery et al. | 206/380 |
| 1,048,285 | A | * | 12/1912 | Brand | 206/126 |
| 1,163,183 | A | * | 12/1915 | Stoll | 206/250 |
| 1,317,501 | A | * | 9/1919 | Huseby | 206/308 |
| 1,505,748 | A | * | 8/1924 | Tamis | 206/250 |
| 1,685,768 | A | * | 9/1928 | Noble | 401/60 |
| 1,985,615 | A | * | 12/1934 | August | 206/527 |
| 2,112,866 | A | * | 4/1938 | Segal | 312/127 |
| 3,091,327 | A | * | 5/1963 | Lalley | 206/455 |
| 4,550,857 | A | | 11/1985 | Castner. Sr. et al. | |
| 4,664,291 | A | | 5/1987 | Gunderson | |
| 4,667,849 | A | | 5/1987 | Hansen | |
| 4,989,730 | A | | 2/1991 | Lemoine | |
| 5,330,056 | A | * | 7/1994 | de la Rocha | 206/581 |
| 5,549,200 | A | | 8/1996 | Cowan et al. | |
| 5,579,910 | A | | 12/1996 | Bennett | |
| 5,873,461 | A | | 2/1999 | Turbett et al. | |
| 5,938,026 | A | * | 8/1999 | Thorn | 206/362 |
| D431,322 | S | | 9/2000 | Lemoine | |
| 6,189,731 | B1 | | 2/2001 | Schmitt | |

FOREIGN PATENT DOCUMENTS

| | | |
|---|---|---|
| WO | WO 95/21110 | 1/1995 |

* cited by examiner

*Primary Examiner*—Mickey Yu
*Assistant Examiner*—Jerrold Johnson
(74) *Attorney, Agent, or Firm*—Peter B. Scull; Berenbaum Weinshienk & Eason

(57) ABSTRACT

A container for swabs with and opening, a hinged lid and a movable internal support member. The movable support member is mechanically linked to the lid so that the support member moves up when the lid is opened so that the swabs protrude from the opening. Grasping a swab is thus facilitated.

20 Claims, 11 Drawing Sheets

100

200

200

CONTAINER FOR COTTON SWABS

BACKGROUND

The present invention relates to the field of cotton swabs, and more specifically relates to the field of cotton swab containers.

U.S. Design Pat. No. 431,322 discloses a container for cotton swabs. The container comprises an upright cylindrical housing with a closed bottom and top. The housing is divided into a lower part and an upper part hinged to the lower part. The upper part serves as a lid. The hinge is placed at the back of the container. A separation line between the upper part and the lower part extends through hinge. At the back of the container the separation line is close to the top of the container. The separation line extends in a curved fashion from the extremities of the hinge towards the front of the container. At the front of the container the separation line is disposed significantly lower than at the back. In the center of the front, the separation line is in the middle of the height of the container. The shape of the separation line creates a cut-out in the front of the lower part. The cut-out allows users, in theory, to grasp a cotton swab by the shaft without touching any of the cotton heads, which is desirable for hygienic reasons. Practice has however shown that it is difficult to grasp a single shaft without touching any of the cotton heads, because not only is the cut-out relatively narrow, particularly when the swabs are compressed in tightly packed manner, it is difficult to grasp and moreover, difficult to manipulate but a single shaft of a compressed bunch of swabs with the fingers without touching any cotton heads in a tightly packed container.

SUMMARY

The invention described herein provides a container for swabs such as cotton swabs that facilitates grasping of a single swab. The container may include a housing defining a chamber with an upward opening for receiving a plurality of swabs in a substantially upright position. A hinged lid may serve to close the opening. The lid is rotatably connected to the housing by a hinge and can move between a closed position and an open position and back. An internal, movable support member may be provided in the chamber on which the cotton swabs may rest. The internal, movable support member may be a bottom member which can be moved between a lower position in which the swabs do not protrude from the opening, and an upper position in which the swabs do protrude from the opening. A mechanism may translate movements of the lid to movements of the internal movable bottom member such that the bottom member may be disposed in the lower position when the lid is in the closed position and the internal movable bottom member may then be disposed in the upper position when the lid is in the open position.

When the bottom member in the upper position it is easy for a user to grasp and manipulate a single swab by its shaft without touching any absorbent material head, even if the container is filled and tightly packed.

In an embodiment, the bottom member may be provided with at least one upright member extending towards the hinge. The lid may be provided with a lever extending from the lid adjacent the hinge, and the upright member may be provided with a recess for receiving a free end of the lever therein.

In another embodiment, the lever may extend at a substantially right angle to the lid and is on its side that faces the container provided with a contour that may ensure a smooth translation of movements of the lid to movements of the bottom.

BRIEF DESCRIPTION OF THE DRAWINGS

In the following detailed portion of the present description, the invention will be explained in more detail with reference to the exemplary embodiments shown in the drawings, in which:

FIGS. 4*a* to 4*e* are isometric and elevational views illustrating another alternative container.

DETAILED DESCRIPTION

Figure 1:
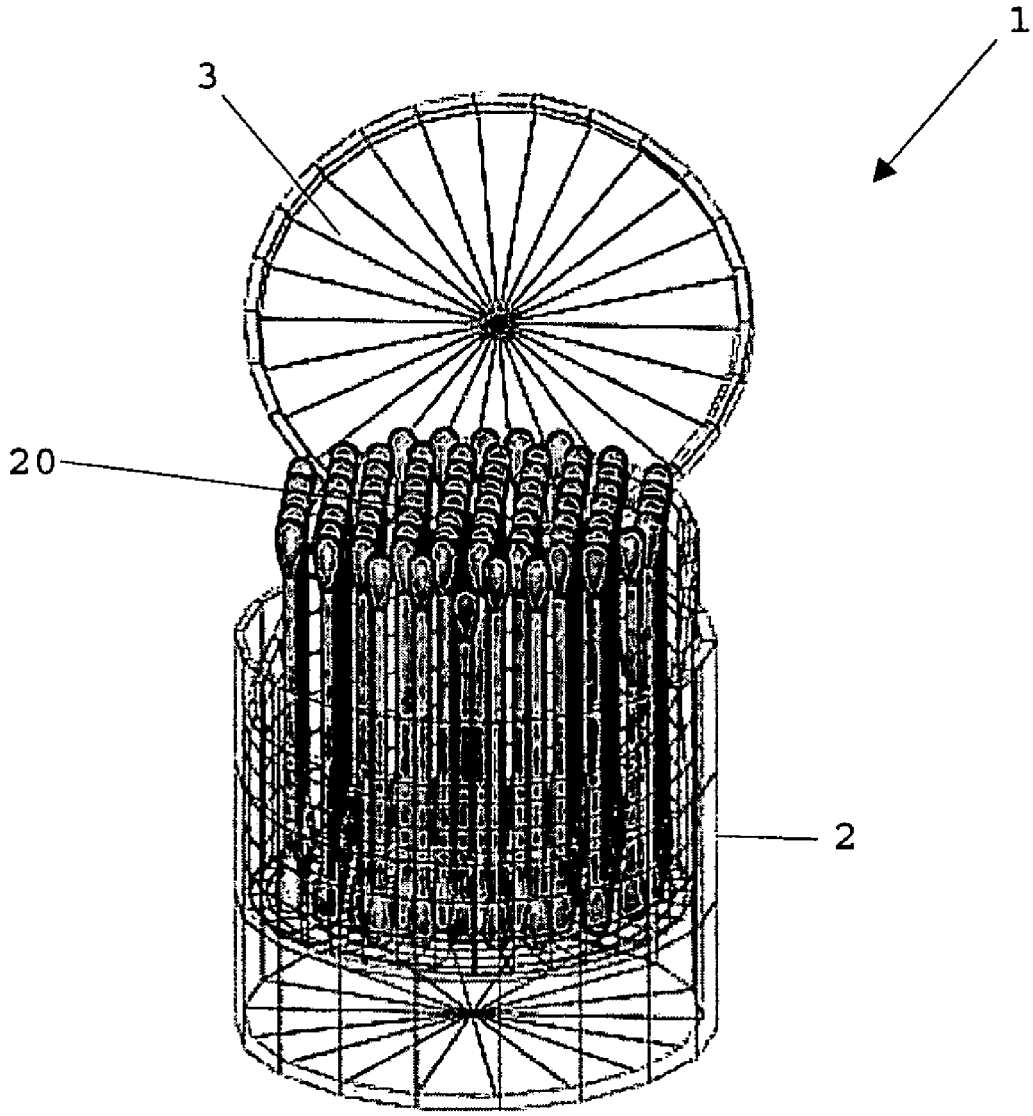
FIG. 1 is a isometric view of a container filled with swabs.

FIG. 1 shows a perspective view of a preferred embodiment of a container 1 for swabs with a housing 2 filled with swabs 20 and a lid 3 in an open position. As shown in FIGS. 2*a* to 2*d*, the housing 2 may be formed by a hollow body having the shape of a truncated cone. As shown here, the housing 2 defines a chamber 4 in and formed by the hollow body and an upward opening 5. Note, other shapes and orientations may be used as well, including for example, cylindrical, rectangular, elliptical, ovate; and/or these may be oriented horizontal or other three dimensional space dispositions, as opposed to the vertical disposition shown.

A movable support member 6 which may also be in the shape of a hollow truncated cone with a closed bottom 7 is received and is movable within the hollow chamber 4. The swabs 20 may be as shown disposed in an upright position in the chamber 4 and rest on the bottom wall 7 of the movable member 6. In this embodiment, the truncated cone of member 6 may be cooperatively shaped, e.g. following the truncated conical shape of and relative to the open chamber 4 of the housing 2.

Figure 2A:
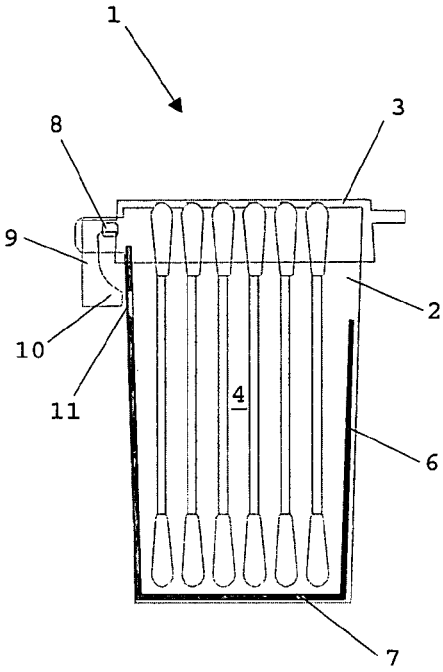
FIGS. 2*a* to 2*d* are cross-sectional views illustrating the container with the lid in different positions.
Figure 2B:
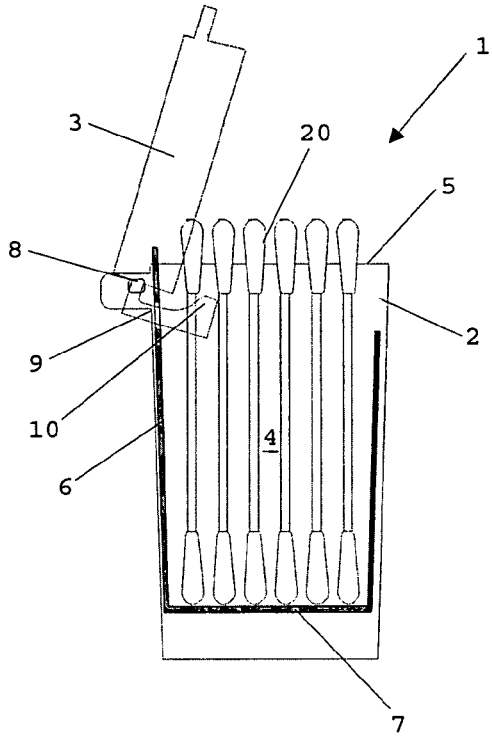
Figure 2C:
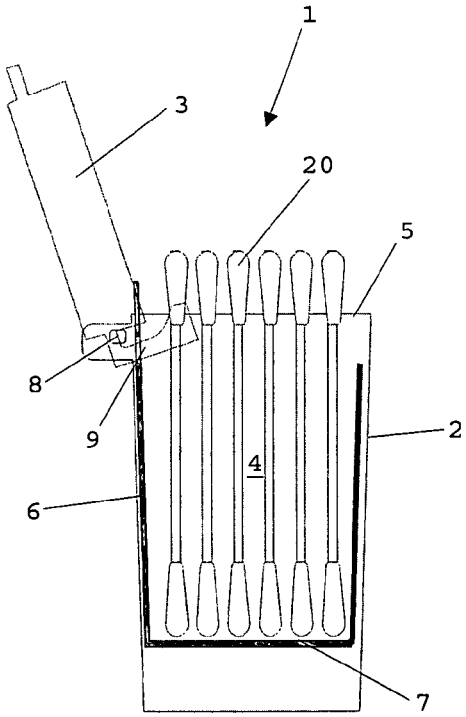
Figure 2D:
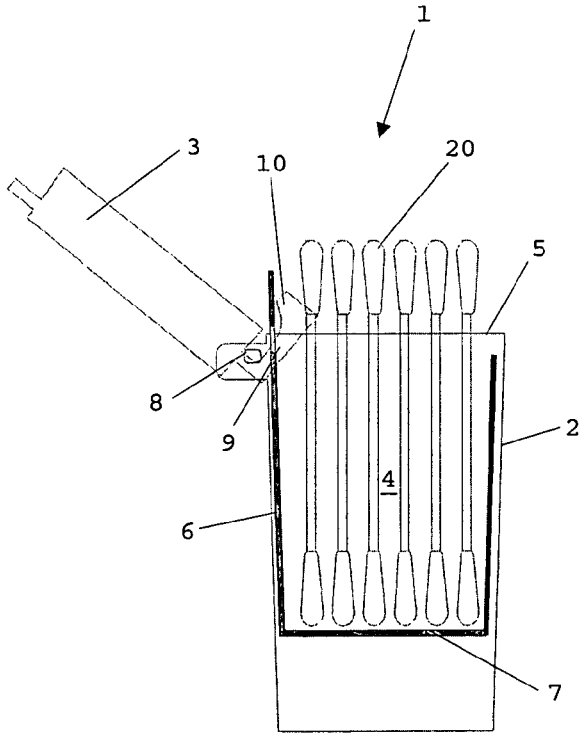
Figure 3A:
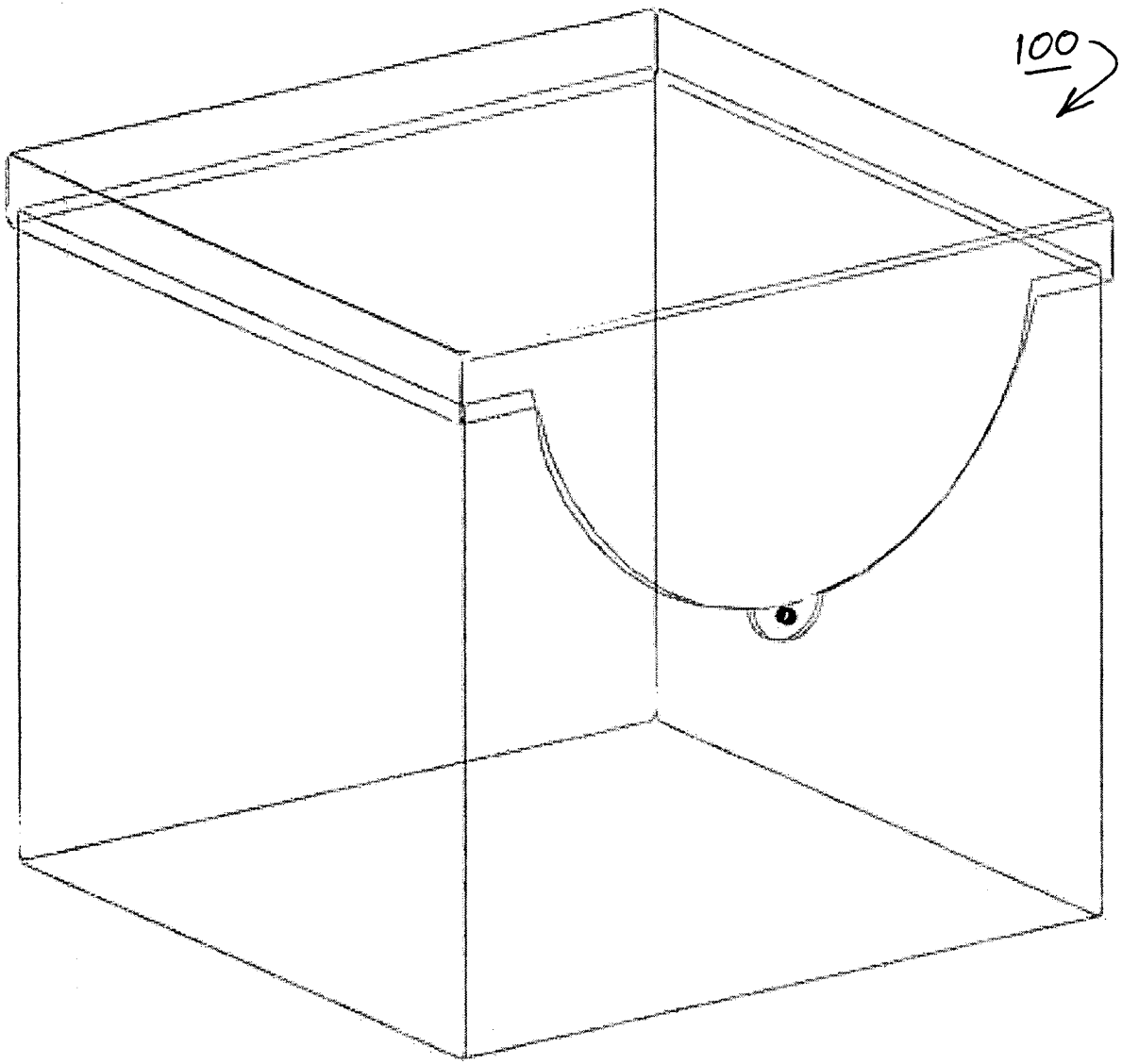
FIGS. 3*a* to 3*d* are isometric and elevational views illustrating an alternative container.
Figure 3B:
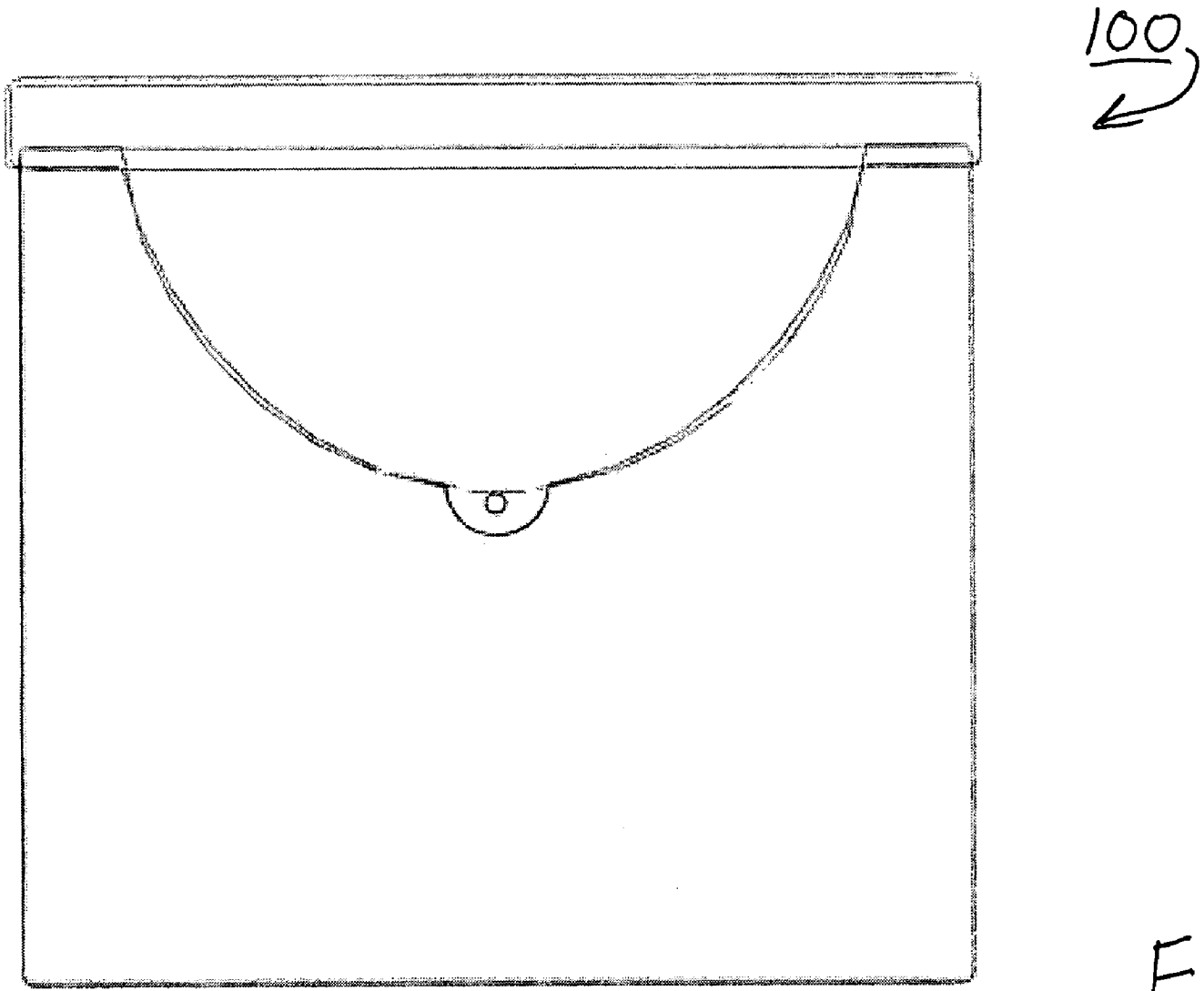
Figure 3C:
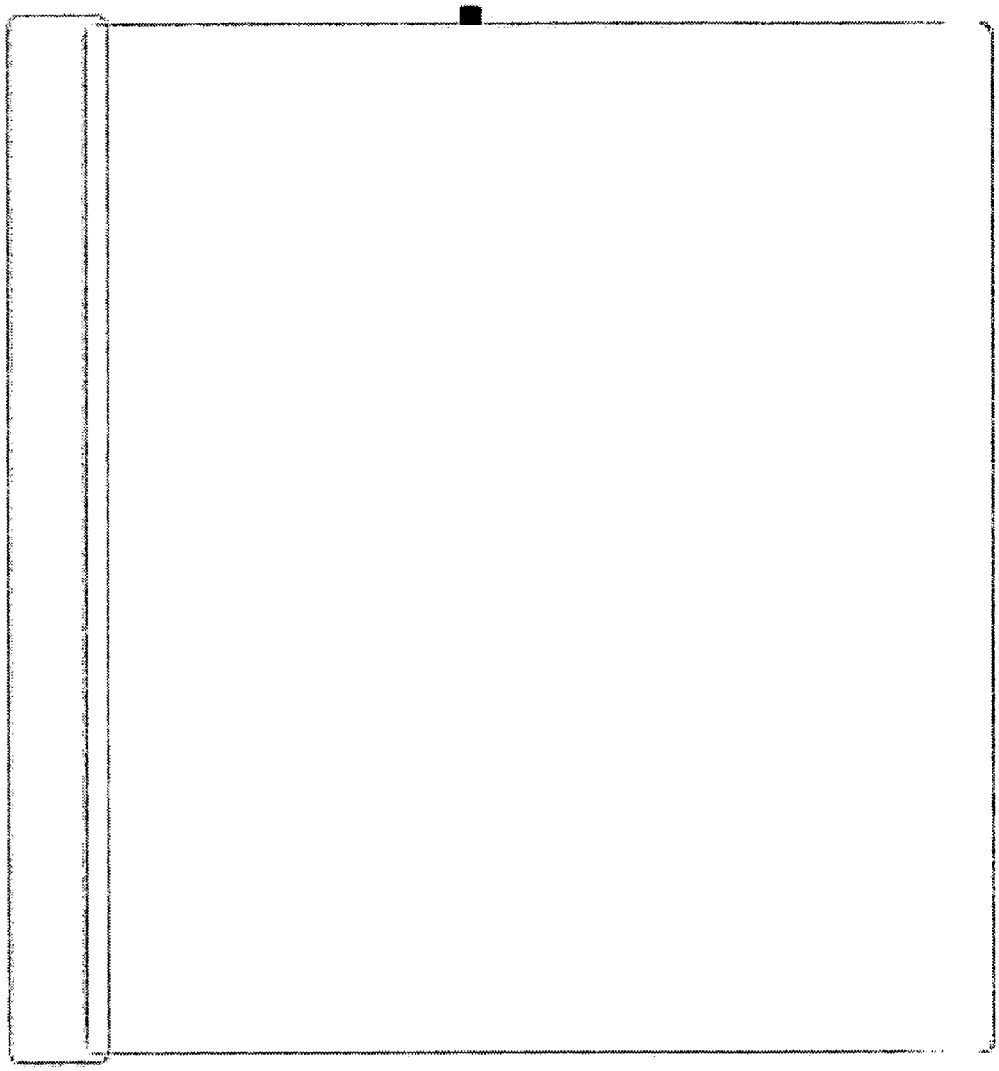
Figure 3D:
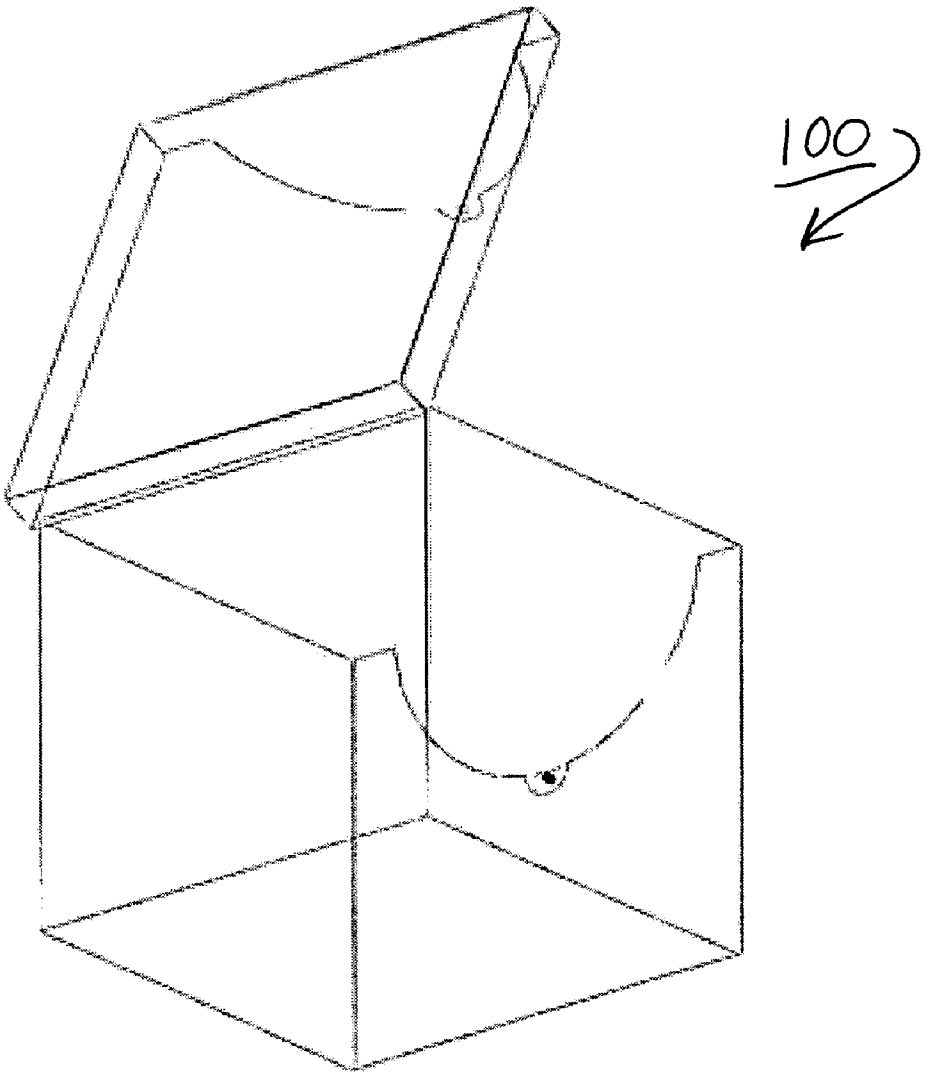
Figure 4A:
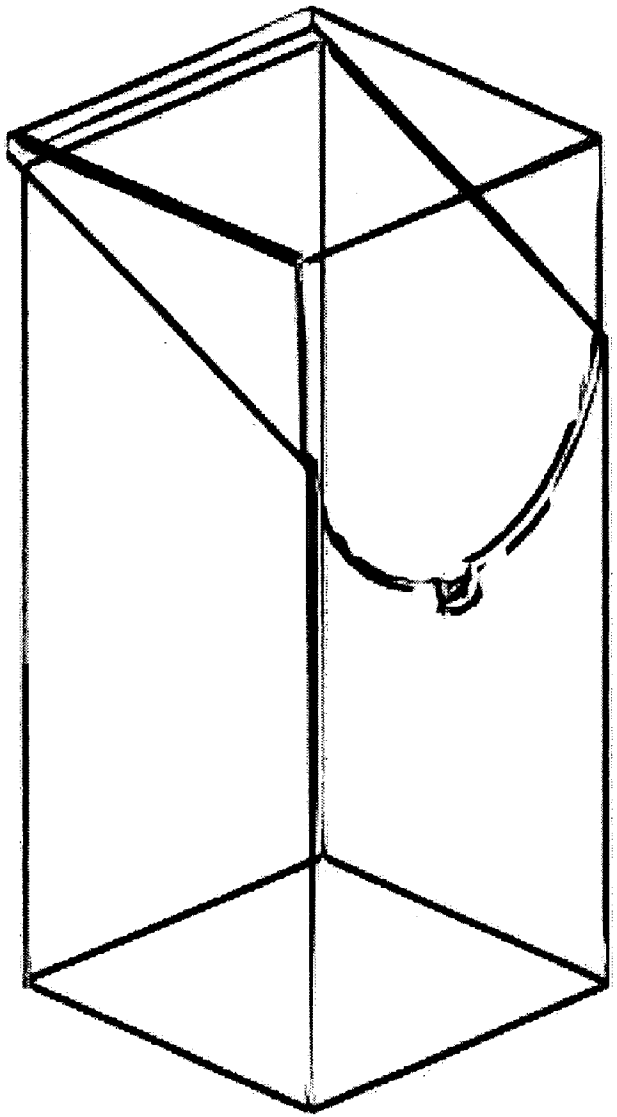
Figure 4B:
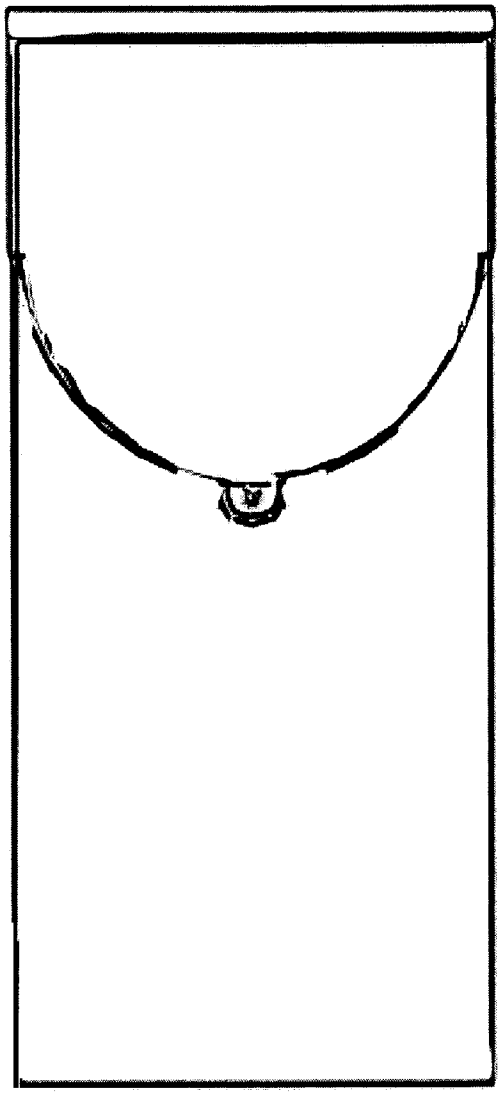
Figure 4C:
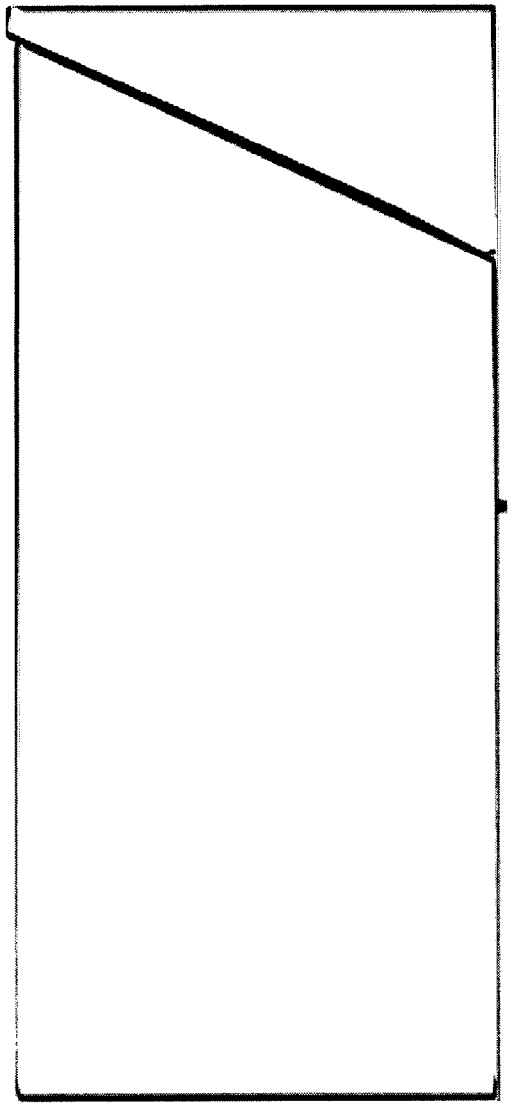
Figure 4A:
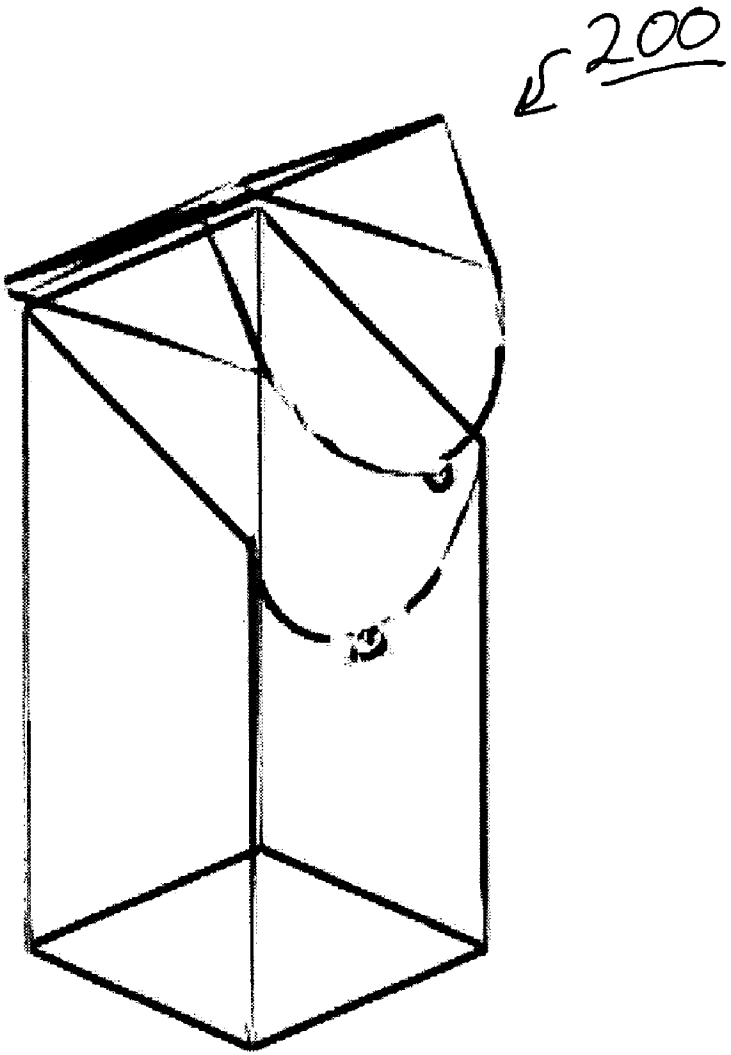
Figure 4E:
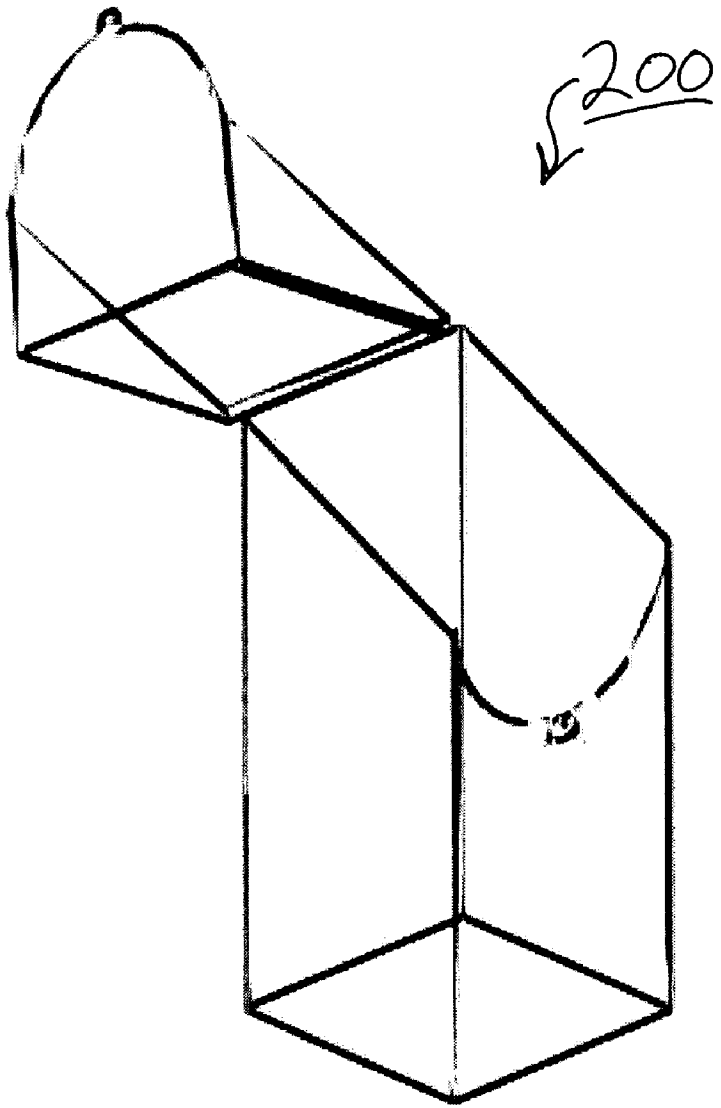

The lid 3 is suspended from or otherwise rotatably connected to the housing 1 by a simple hinge 8. The lid 3 can be moved often manually between a closed position as shown in FIG. 2*a* to an open position as shown in FIG. 2*d*. FIGS. 2*b* and 2*c* illustrate positions of the lid in intermediate positions between the relative open and the closed positions.

A lever 9 is also shown as connected to and extending at a substantially right angle from the lid 3. A free end 10 of the lever 9 is configured to pass through a cooperative opening or slit (not shown) in the housing 1 and enters a recess 11 in the upper part of the movable member 6 close to or adjacent the hinge 8. The side of the lever 9 that faces the housing 1 when the lid 3 is in the closed position has a contour that ensures a smooth translation of the movement of the lever 9 to the movable member 6.

As shown in FIG. 2*a* the movable member is in its lower position when the lid is closed. When the lid 3 is moved from the closed position of FIG. 2*a* to a partially open position in FIG. 2*b*, the free end 10 enters the recess 11 and the contoured side of the lever 9 engages the upper side of the recess 11 and forces the movable member 6 with the swabs 20 resting on the bottom 7 upwards from its lower position. The movable member 6 continues an upward movement when the lid 3 is moved from the partially open position of FIG. 2*b* to the further partially open position of FIG. 2*c* and onwards to the (completely) open position of FIG. 2*d*. In the process, the movable member 6 with the swabs 20 resting on the bottom 7 moves from the lower position of FIG. 2*a* via intermediate positions in FIGS. 2*b* and 2*c* to an upper position of FIG. 2*d*.

Note, the lever 9 may provide a relative levering effect in moving the movable member 6, or as shown, the lever 9 may be in a slidable, movable contact with the recess in the extending member of the movable member 6. This may thus provide a sort of camming effect in the movement of the movable member 6. Such a levering and/or camming effect by lever 9 on movable member 6 may provide for moving the movable member 6 in a substantially translational manner; here depicted as moving substantially alternately upwardly and downwardly. The movement of the lid 3 and the lever 9 may, as shown, be substantially rotational and the lever 9 as it acts on the member 6 may then act together to convert to a translational movement of member 6. Note, this forced movement can be as shown for lifting the member 6 toward the opening in chamber 4 and/or it may also be used to force the opposite action of member 6 away from the opening (particularly if the disposition is other than upward and downward). Otherwise, if properly positioned, gravity may assist in any downward motion.

When the movable member 6 is in the upper position of FIG. 2*d* it is easy for a user to grasp a single swab 20 by its shaft without touching any absorbent head, even if the container 1 is completely filled and tightly packed with swabs 20.

By using a lever 9 connected to the lid 3, the bottom 7 is raised over a relatively large distance when the lid is moved from the closed to the open position thus, creating a pop-up effect. The pop-up effect urges all the swabs 20 upwardly and outwardly, and may also allow for some spreading of the swab tips away from each other upon protrusion of the swab tips from the chamber through the opening. This may increase the ability to grasp and remove a single swab separately from the group. This spreading effect may occur with any of the container shapes, however it may be enhanced with a truncated conical shape, as shown, or the like, where the swabs 20 have already been angled toward having their respective tops spread apart from each other, which effect is emphasized the further they may be moved in the direction of the widening cone.

The reverse of the pop-up effect may also assist in the urging of the swabs 20 back into the container after use because the side walls of the movable member 6 may assist in pushing the swabs 20 back to place. Note, the truncated conical shape, if used, may provide gentle assistance in pushing the swabs back into their relative places. Swabs 20 can sometimes hang together due to the fibers sticking to each other, causing them to be out of array. The lid 3 will—when it is moved to the closed position—push any cotton swab 20 which is out of array down to the same level.

The shape of the housing 1 can be mainly ornamental, preferably such that the housing can stand upright. The horizontal cross-sectional shape of the housing is not essential and it can e.g. be round, elliptic, squared, triangular, or rectangular. The housing is preferably produced by injection molding plastic material. The vertical cross-sectional shape may thus preferably be tapered for easy removal of the plastic housing from a mold used in the injection molding process.

The mechanism that translates the movements of the lid 3 to the bottom 7 on which the cottons swabs 20 rest does not need to be of the illustrated type with a lever that engages a recess. The mechanism could use cables, cams, gears, rods and any other mechanical transmission components and assemblies thereof. Note, the movable member 6 could in some embodiments substantially be solely a bottom member 7 so that the lever or other mechanism engages and moves the bottom member in support of the swabs. Maintenance of the swabs in upright position may be accomplished through support provided by the side walls of the housing 2 as these define the chamber 4.

FIGS. 3*a* to 3*d* and FIGS. 4*a* to 4*e* are isometric and elevational views illustrating alternative containers 100 and 200. Such alternative containers may or may not be used with and/or in accord with the mechanism for movement as described herein.

As described herein, the absorbent end of each of the swabs 20 may be formed of cotton or like material products as may be understood. For example, cosmetic or medical cotton or like natural and/or synthetic materials or other soft material may be used and attached to a small stick or shaft, wire, or plastic wand with the cottonish material attached to one or both ends. In cosmetic situations, such swabs may often be used to apply or remove makeup or polish or other cosmetic materials. Similarly, cotton swab or like material products have been known for use in medical applications as in providing sanitary cleaning or disinfecting and/or as absorption materials for bodily fluids, to clean wounds, to mop up blood during surgery, to apply medicine, or obtain a specimen of something; e.g., of a secretion obtained by using a swab, or for example in surgical or like situations as a soft absorbent material for mopping up blood. Additionally, the cotton or like materials hereof may be used in any of many other areas of traditional cotton or like fiber usage.

Herein, the word cottonish may be used to define the types of material products to be used with/on swabs to be dispensed in accord herewith. Cottonish therefore encompasses cotton as understood in the art, e.g. for cosmetic or medical or other uses; and cottonish also encompasses the like or other combination or substitute material products which can be used herein, as for example cotton blends with other natural or synthetic materials, and/or the non-cotton products made of other natural or synthetic materials (e.g., wools or rayons, inter alia). Also, the cottonish material may be cotton or a mixture or solely a cotton substitute, usually of an absorbent nature, may be used within and/or as part of the present invention. Such a substitute can be produced from wool, jute/jute wastes, hemp or other natural fibrous and/or absorbent goods, and/or by or with synthetic materials, e.g., acrylics, polyesters, rayon or dacron or other such materials. Also, substitutes may be made by blending of any of these substances with each other, as for example, combining discrete natural products; discrete synthetics and/or naturals with synthetics as cotton with rayon, inter alia. The cotton substitute may in many preferred instances be absorbent and as with the cotton products discussed above can be used for cosmetic situations, e.g., facial application and/or cleaning and/or for removing nail polish; and/or for medical applications such as in providing sanitary cleaning and/or absorption materials for bodily fluids, as described above and/or for other sanitary, or in other areas of cotton or cotton like material swab usage.

While preferred embodiments of the device have been described in reference to the environment in which they were developed, they are merely illustrative of the principles of the invention. Other embodiments and configurations may be devised without departing from the spirit of the invention and the scope of the appended claims.

What is claimed is:

1. A container for swabs comprising:

a housing defining a chamber with an opening for receiving and containing a plurality of swabs therein;

a hinged lid for alternately opening and closing said opening of said housing, said lid being connected to said housing by a hinge and said lid being capable of moving in a substantially rotational motion pivoting about said hinge, moving between a closed position and an open position relative to said opening of said housing;

a translationally movable internal support member movably disposed within said chamber for supporting said swabs, said support member being capable of moving substantially translationally between a first position in which said swabs do not substantially protrude from said opening, and a second position in which said swabs substantially protrude from said opening; and, a mechanism rigidly connected to the lid and disposed to engage in movable contact with the support member, the mechanism linking the rotational motion of said lid to at least partially cause movement of said support member such that the support member is disposed in the first position when the lid is in the closed position and the support member is disposed in the second position when the lid is in the open position;

whereby in the first position the mechanism is not in contact with the support member and in the second position the mechanism is in contact with the support member whereby the mechanism creates a camming effect in its movable contact with said support member to cammingly move the support member.

2. A container according to claim 1, wherein the swabs are bundled.

3. A container according to claim 1, wherein the mechanism linking the rotational motion of the lid with movement of the support member is a lever substantially fixedly connected to said lid, and operatively connected in a movable contact relation to said support member such that as the lid is moved, the lever is caused to move therewith in a rotational motion and the lever causes by contact movement a motion of the support member.

4. A container according to claim 3, wherein the lever creates a levering effect in its movable contact relation with said support member to move the support member by levering the support member.

5. A container according to claim 1, wherein the container is adapted to contain a plurality of double-headed cotton swabs.

6. A container according to claim 3, wherein the lever creates an effect selected from the group of a levering effect and a camming effect either of which providing for moving the support member in a translational direction.

7. A container according to claim 3, wherein said support member has attached thereto at least one extension member extending towards the hinge; and wherein the lever extends from the lid adjacent the hinge, and the extension member has a recess formed therein for operatively receiving a free end of the lever therein, the free end of the lever operatively engaging the extension member via the recess, operative to transmit motion thereto.

8. A container according to claim 1, wherein said opening of said housing opens substantially upwardly;

wherein said opening provides for receiving a plurality of swabs in a substantially upright position;

wherein said support member is a bottom member for supporting the swabs in a substantially upright position; and, wherein said first and second positions of said support member are respective lower and upper positions within the chamber of said housing.

9. A container according to claim 8, wherein said bottom member has attached thereto at least one upright member extending upwardly towards the hinge.

10. A container according to claim 9, wherein the lid is provided with a lever extending therefrom adjacent the hinge, and the upright member is provided with a recess for receiving a free end of the lever therein.

11. A container according to claim 10, wherein said lever extends at a substantially right angle to said lid.

12. A container according to claim 11, wherein the lever includes a side that faces the container, and wherein the side of the lever that faces the container is provided with a contour that ensures a smooth translation of a movement of the lid to a movement of the bottom member.

13. A container according to claim 8, wherein the movement of said bottom member is substantially translational alternately upwardly and downwardly.

14. A container according to claim 8, wherein the mechanism linking the rotational motion of the lid with movement of the support member is a lever substantially fixedly connected to said lid, and operatively connected in a movable contact relation to said support member such that as the lid is moved, the lever is caused to move therewith in a rotational motion and the lever causes by contact movement a motion of the support member.

15. A container according to claim 14, wherein the lever creates an effect selected from the group of a levering effect and a camming effect either of which providing for moving the support member in a translational direction.

16. A container according to claim 1, wherein the swabs have an absorbent end selected from the group consisting of cotton and cottonish material.

17. A swab dispensing system comprising:

at least one swab;

containing means for containing said at least one swab; said containing means including covering means for covering the at least one swab within the containing means, the covering means being rotatably connected to the containing means to alternately open and close the containing means;

a movable internal support means for supporting the at least one swab;

whereby the movable internal support means is operatively mechanically linked to the covering means by a rigid camming means on the covering means, the rigid camming means creating a camming effect in its movable contact with said support means to cammingly move the support means such that rotational movement of the covering means causes translational movement of the movable support means; and whereby operative mechanical linkage of the covering means by the rigid camming means to the internal support means is such that the camming means is movable between a first position in which the camming means is not contact with the support means and a second position in which the camming means is in contact with the support means.

18. A method for dispensing swabs comprising:

providing a container having at least one swab disposed therein, the container having an opening and lid rotatably connected to the container to alternately open and close the container opening; the container also having a movable internal support member disposed therein for supporting the at least one swab;

moving the lid from a closed position to an open position, whereby the movable internal support member also moves in response to movement of the lid, the support member being operatively mechanically linked to the lid by a rigid camming member on the lid, the rigid camming member creating a camming effect in its movable contact with said support member to cammingly move the support member such that rotational movement of the lid causes translational movement of the movable support member, the camming member being disposed to be movable between a first position in which the camming member is not in contact with the support member and a second position in which the camming member is in contact with the support member, the movement of the lid causing a protrusion of the at least one swab from the opening of the container;

removing at least one swab from the container.

19. A method according to claim 18 wherein the swabs are bundled.

20. A method according to claim 18, wherein the mechanical linkage of the support member to the lid is such that rotational movement of the lid causes translational movement of the movable support means, the mechanical linkage being selected from the group consisting of a lever and a cam, and the method further comprising levering or camming the support member to cause translational movement thereof.

* * * * *